US007849862B2

(12) United States Patent
De Laforcade

(10) Patent No.: US 7,849,862 B2
(45) Date of Patent: Dec. 14, 2010

(54) HAIR HOLDING DEVICE, A METHOD OF USING SUCH A DEVICE, AND A KIT INCLUDING SUCH A DEVICE

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 826 days.

(21) Appl. No.: 10/840,295

(22) Filed: May 7, 2004

(65) Prior Publication Data

US 2004/0226570 A1 Nov. 18, 2004

Related U.S. Application Data

(60) Provisional application No. 60/472,464, filed on May 22, 2003.

(30) Foreign Application Priority Data

May 7, 2003 (FR) ..... 03 05558

(51) Int. Cl.
*A45D 19/18* (2006.01)
*A61K 8/18* (2006.01)

(52) U.S. Cl. ..... 132/270; 132/202

(58) Field of Classification Search ..... 132/273, 132/274, 275, 55, 280–284, 270; 24/30.5 S, 24/30.5 R, 545, 563, 30.5 I, 557, 543, 546; D28/39–42
See application file for complete search history.

(56) References Cited

U.S. PATENT DOCUMENTS 578,652 A * 3/1897 Morrison ..... 131/257
1,547,736 A * 7/1925 Curtis ..... 383/23
2,031,483 A * 2/1936 Interrante ..... 132/281
2,272,409 A * 2/1942 Johnson ..... 132/281
2,299,017 A 10/1942 Hoffman
2,327,762 A * 8/1943 Bull ..... 205/70
2,636,704 A * 4/1953 Norberg ..... 248/79
2,664,883 A * 1/1954 Smith ..... 132/281
3,194,248 A * 7/1965 Callies ..... 132/284
3,236,246 A * 2/1966 Culligan ..... 132/281
3,468,318 A * 9/1969 Cook et al. ..... 132/270
4,189,808 A * 2/1980 Brown ..... 24/30.5 R
4,285,350 A * 8/1981 Cox et al. ..... 132/212
4,503,870 A * 3/1985 Peterson ..... 132/270
4,665,594 A * 5/1987 Wagner ..... 24/546
4,760,855 A * 8/1988 DiLorenzo ..... 132/270
4,809,894 A * 3/1989 Viio ..... 224/248
5,319,835 A * 6/1994 Chao ..... 24/67.9
5,771,906 A * 6/1998 De Benedictis ..... 132/207
5,865,191 A 2/1999 Kimeta
5,972,044 A * 10/1999 Braun et al. ..... 8/405
6,295,993 B1 * 10/2001 Ouellette ..... 132/208
6,378,531 B1 4/2002 Marquis

FOREIGN PATENT DOCUMENTS

DE 662 702 C 7/1938

* cited by examiner

*Primary Examiner*—Rachel R Steitz
(74) *Attorney, Agent, or Firm*—Oliff & Berridge, PLC

(57) ABSTRACT

A device for holding a lock of hair is provided. The device includes a base portion for resting on the scalp; a holding portion arranged to hold a portion of the lock in a substantially upstanding configuration between the holding portion and the scalp; and a link portion connecting the base portion to the holding portion and configured in such a manner as to allow access to the portion of the lock.

26 Claims, 3 Drawing Sheets

HAIR HOLDING DEVICE, A METHOD OF USING SUCH A DEVICE, AND A KIT INCLUDING SUCH A DEVICE

CROSS-REFERENCE TO RELATED APPLICATIONS

This non provisional application claims the benefit of French Application No. 03 05558 filed on May 7, 2003, and U.S. Provisional Application No. 60/472,464 filed on May 22, 2003, the entire disclosures of which are incorporated by reference herein.

FIELD OF INVENTION

The present invention relates to devices, methods and kits for facilitating treatment of the hair, and more particularly hair roots.

BACKGROUND

It is known to apply substances to the hair. Such substances may be in the form of a gel that dries relatively slowly, for example.

SUMMARY OF THE INVENTION

Exemplary embodiments of the present invention provide devices, methods and kits that make it easier to use slow-drying substances for giving volume to the hair.

Exemplary embodiments of the present invention provide devices, methods and kits for facilitating treatment of the hair, for example, to obtain a hair volume effect by applying a substance. In exemplary embodiments, the substance may be a polymer-rich substance that is capable of holding hair roots spaced apart from the scalp.

In various exemplary embodiments, the invention provides a device for holding a lock of hair, the device comprising: a base portion for resting against the scalp; a holding portion arranged to hold a portion of said lock substantially upstanding between the holding portion and the scalp; and a link portion connecting the base portion to the holding portion and configured in such a manner as to allow access to said portion of said lock. In exemplary embodiments, the link portion is configured to allow a hair care substance to be applied to said portion of said lock. In exemplary embodiments, the holding portion may be situated substantially above the base portion at a non-zero distance therefrom.

Such a device enables hair roots to be held in an upstanding configuration on the scalp, for example, for a long enough time to allow a substance, used to fix the hair in position, to dry.

In exemplary embodiments, the link portion may advantageously be arranged in such a manner that the hair-holding portion can be moved toward the base portion by elastically deforming the device. In such embodiments, a light resilient return force can be exerted on the hair so as to keep the hair under a certain amount of tension while the substance is being applied and while the substance is drying.

In exemplary embodiments, the link portion may extend substantially obliquely between the holding portion and the base portion.

Still, in exemplary embodiments, the base portion may be in the form of a circular arc. Such embodiments may make it easier to apply the device to the scalp and to deform the link portion elastically.

According to various exemplary embodiments of the invention, the link portion may be made in various ways. For example, in embodiments, the link may be generally U-shaped with limbs that are connected to the base portion. In embodiments in which the base portion is in the form of a circular arc, the two limbs may be connected respectively to two circumferential ends of the base portion.

In exemplary embodiments, the link portion and the base portion may advantageously be made integrally, i.e., monolithically, for example, by molding a plastics material. In exemplary embodiments, the holding portion may also be made integrally, i.e., monolithically, with the link portion, for example, by molding a plastics material. In exemplary embodiments, the entire device may be made as a single piece by molding a plastics material.

According to various exemplary embodiments of the invention, the holding portion may be made in various ways. For example, the holding portion may include a clip, such as, for example, an elastically deformable clip.

For example, in exemplary embodiments the clip may be made with at least one branch hinged relative to another branch, such as, for example, by at least one film-hinge. In exemplary embodiments, the clip comprises two branches each hinged via a film-hinge to the link portion, the two branches being arranged in such a manner as to be capable, when in a close-together position, of co-operating so as to clamp hair between them. Co-operation between the branches may be achieved, for example, by a rim formed at a free end of one of the branches on which the other branch may snap-fasten.

In exemplary embodiments, the clip may also be made with two branches at a spacing that may be selected in such a manner as to make it possible to clamp onto hair. In exemplary embodiments, the two branches may include two substantially touching edges with sufficient elasticity to enable the user to insert the hair that is to be held between said edges.

In exemplary embodiments, the branches may be covered in an outer sleeve of a compressible material, for example, a foam.

In exemplary embodiments, the branches may include two diverging portions, making it easier to insert hair therebetween.

Exemplary embodiments of the present invention provide a device for holding a lock of hair, the device comprising: a base portion for resting on the scalp; a holding portion comprising a clip arranged to hold a portion of said lock in a substantially upstanding configuration between the holding portion and the scalp; and a link portion connecting the base portion to the holding portion, the link portion being arranged in such a manner that the holding portion can be moved toward the base portion by elastically deforming the device.

Exemplary embodiments of the present invention provide a method of treating hair, the method comprising: holding root portions of a lock of hair in an upstanding configuration on the scalp by using a device as defined above; and applying a hair care substance to the roots of the hair held with the device.

For example, in exemplary embodiments the substance may be a substance that hardens on drying, so as to lock the hair roots in the orientation given thereto by the device.

In exemplary embodiments, the substance may be constituted by a polymer-rich gel, for example, a gel having a drying time that is greater than or equal to twenty seconds.

Exemplary embodiments of the present invention provide a hair care kit comprising a device as defined above together with a substance for applying to hair roots. For example, in exemplary embodiments, the substance may be a substance for locking the roots in a particular orientation on drying.

BRIEF DESCRIPTION OF THE DRAWINGS

The invention can be better understood on reading the following detailed description of non-limiting embodiments thereof, and on examining the accompanying drawings, in which.

DETAILED DESCRIPTION OF EXEMPLARY EMBODIMENTS

Figure 1:
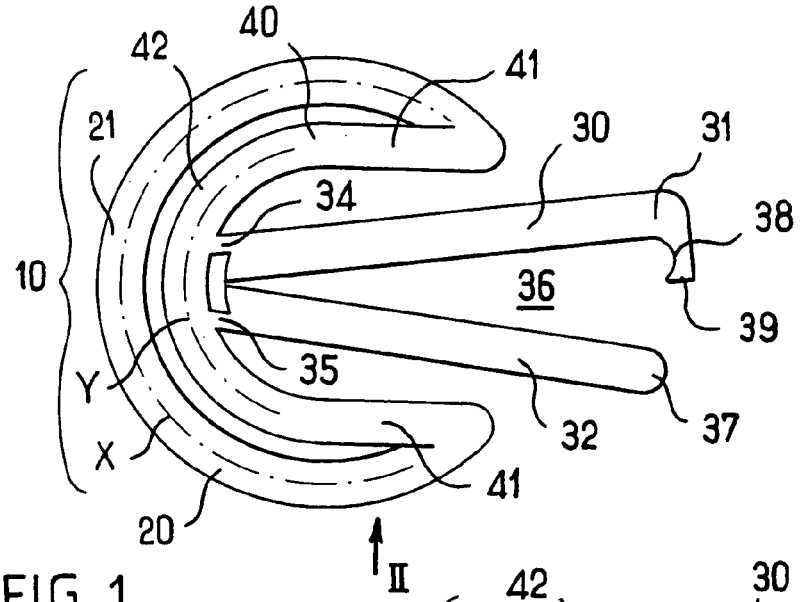
FIG. 1 is a plan view of a first exemplary embodiment of a device according to the invention, the holding portion being shown in an open configuration enabling hair to be inserted.
Figure 2:
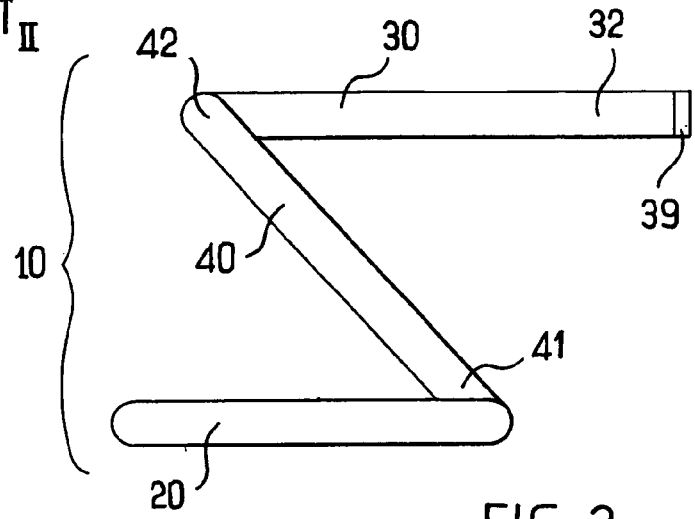
FIG. 2 is an elevation view of the first exemplary embodiment as seen looking along arrow II in FIG. 1.
Figure 3:
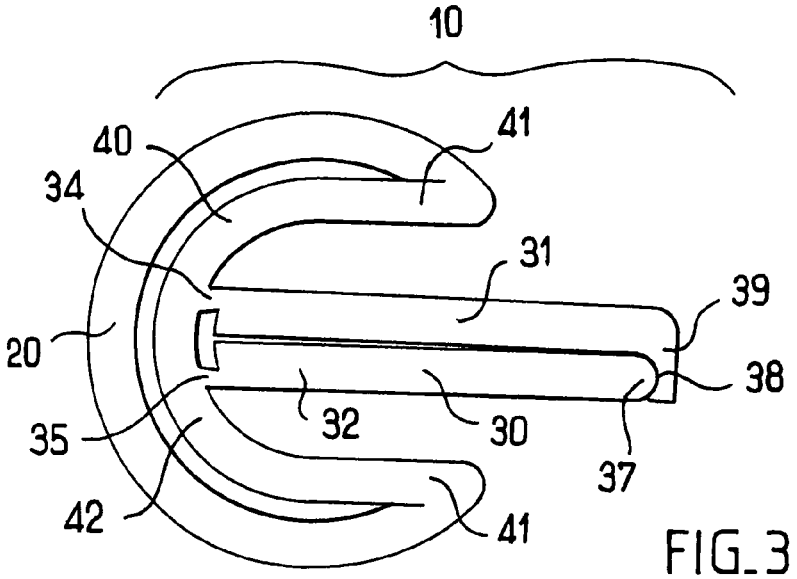
FIG. 3 is a plan view of the first exemplary embodiment, analogous to FIG. 1, the holding portion being shown in a closed position for holding hair inserted therein.

FIGS. 1 to 3 show a first exemplary embodiment of a device 10 comprising a base portion 20, a holding portion 30, and a link portion 40 interconnecting the base portion 20 and the holding portion 30.

In the first exemplary embodiment of FIGS. 1 to 3, the device 10 is made as a single piece by molding a plastics material, for example, a relatively rigid plastics material. Such materials including, but not limited to, a polyolefin, such as polypropylene or polyethylene, acrylonitrile-butadiene-styrene copolymer (ABS), styrene polymers, and polyamides.

In the first exemplary embodiment, the base portion 20 comprises an elongate body of circular cross-section extending along a curvilinear longitudinal axis X, which is circular in the first exemplary embodiment, with radius lying in the range fifteen millimeters (mm) to thirty millimeters, for example. In the first exemplary embodiment, the body of the base portion 20 extends over an angular sector of about 270°.

As shown in FIG. 1, the link portion 40 is generally U-shaped, comprising two limbs 41, each connected to a corresponding end of the base portion 40.

The limbs 41 are of circular cross-section and extend obliquely upward going toward a middle portion 21 of the base portion 20. A curvilinear portion 42 having the same circular cross-section unites the limbs 41. This curvilinear portion 42 extends along a longitudinal axis Y that is substantially concentric with the axis X when the device 2 is observed from above. As shown in FIG. 1, the curvilinear portion 42 extends over an angular sector of about 180°.

The holding portion 30 comprises a clip with two branches 31 and 32 that are connected to the curvilinear portion 42 by respective thin portions 34 and 35 that define film-hinges. Thus, the branches 31 and 32 can pivot relative to the link portion 40 between an open position, as shown in FIG. 1, that allows hair to be treated to be inserted into the space 36 therebetween, and a closed position, as shown in FIG. 2, in which the hair can be held in place by being clamped between the branches 31 and 32. The branches can co-operate, for example, by an end 37 of the branch 32 snap-fastening in a recess 38 defined by a rim 39 on the branch 31.

The device 10 may be used as follows.

Figure 4:
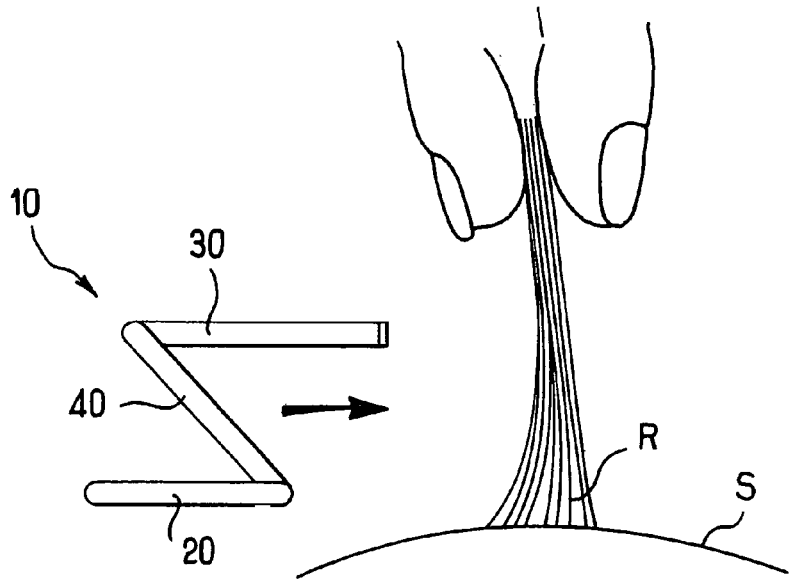
FIGS. 4 to 6 illustrate the exemplary device of FIGS. 1 to 3 in use for holding hair.

A user takes hold of a lock of hair so as to cause the hair roots R to be upstanding on the scalp S, and then introduces the hair between the branches 31 and 32, as shown in FIG. 4.

Figure 5:
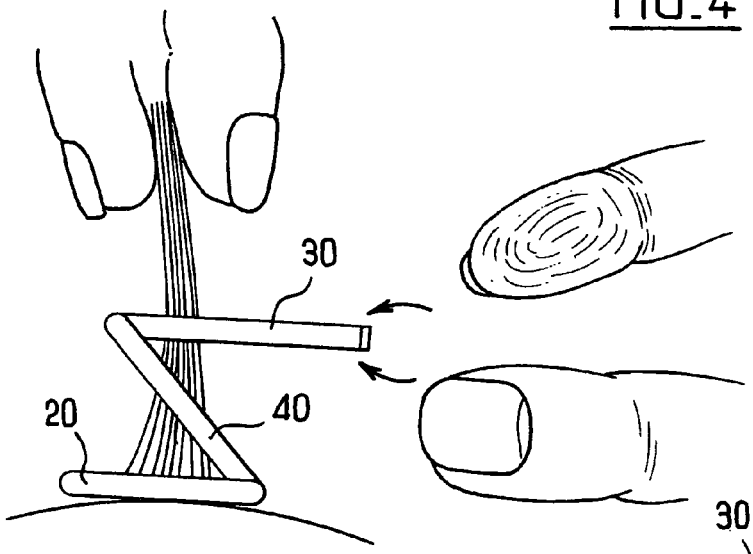
Figure 6:
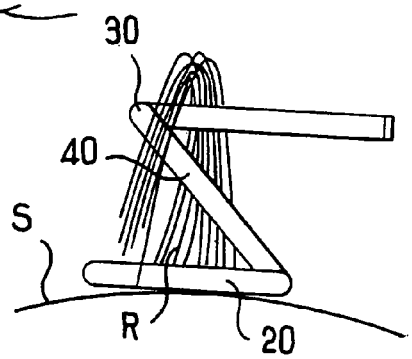

The user can then close the clip, for example, by using the thumb and forefinger of the other hand, as shown in FIG. 5, and let go of the hair. The roots R remain upstanding on the scalp S because the hair is held in the branches 31 and 32, as shown in FIG. 6. The general shape of the device, and for example, the inclination of the link portion 40 relative to the base portion 20, enables a certain amount of flexibility to be given to the device as a whole, thus making it possible to exert tension on the hair that is being held. The user can then put a substance onto the upstanding roots R, such as, for example, a gel, and leave the device 10 in place for a length of time needed to allow the substance to dry prior to removing the device.

Various modifications to the device are contemplated by the invention. For example, various modifications to the holding portion are contemplated by the invention, as described below with reference to FIGS. 7 to 10.

Figure 7:
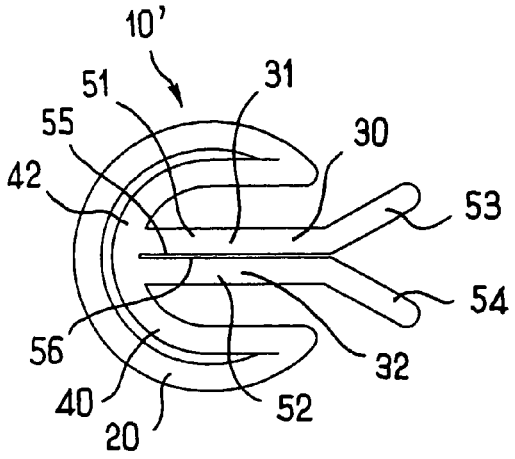
FIG. 7 is a plan view of a second exemplary embodiment of a device according to the invention.

A second exemplary embodiment of a device 10' is shown in FIG. 7, which differs from the first exemplary embodiment described above by the shape of the holding portion 30. In the second exemplary embodiment, the holding portion 30 comprises branches 31 and 32 that are not hinged to the link portion 40 by film-hinges.

The branches 31 and 32 have respective parallel rectilinear portions 51 and 52 of circular cross-section and respective end portions 53 and 54 that diverge going away from the curvilinear portion 42 so as to make it easier to insert hair between the branches 31 and 32.

The rectilinear portions 50 and 51 have respective adjacent edges 55 and 56 that are touching or spaced apart by only a small distance, so as to enable them to clamp onto hair that is inserted therebetween.

Figure 8:
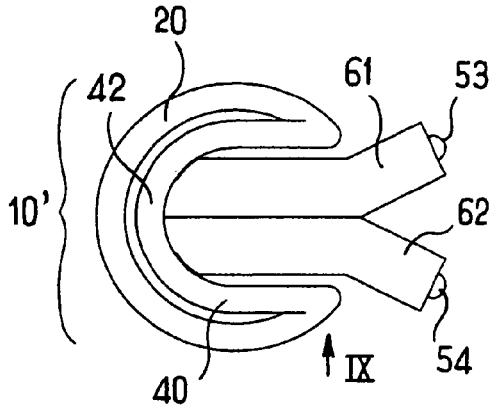
FIG. 8 is a plan view of a third exemplary embodiment of the device according to the invention.
Figure 9:
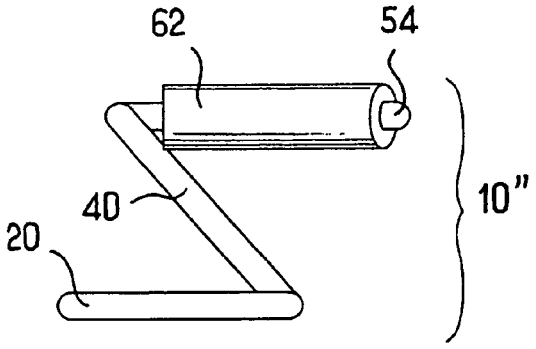
FIG. 9 is an elevation view of the third exemplary embodiment as seen looking along arrow IX of FIG. 8.
Figure 10:
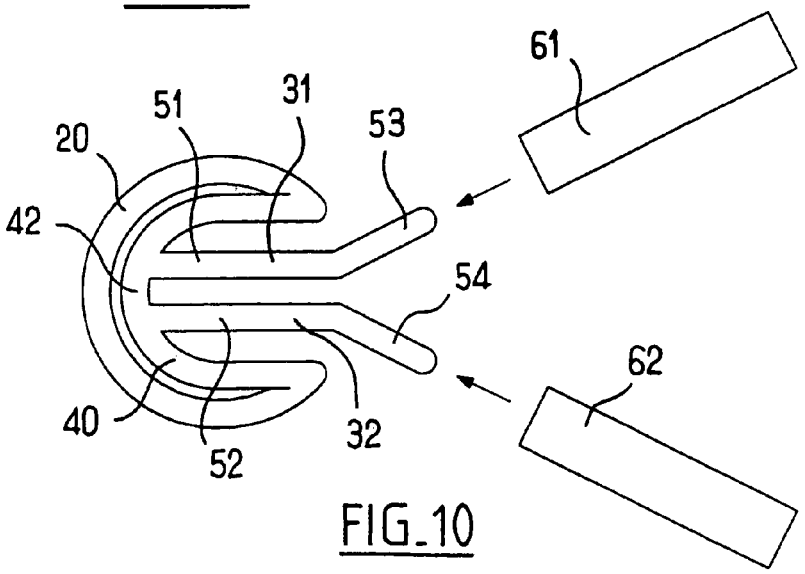
FIG. 10 illustrates a step in the manufacture of the third exemplary device of FIG. 8.

A third exemplary embodiment of a device 10" is shown in FIGS. 8 and 9, which differs from the second exemplary embodiment shown in FIG. 7 by the fact that the spacing between the rectilinear portions 51 and 52 is greater, as shown in FIG. 10, thereby enabling respective sleeves 61 and 62 to be engaged thereon. The sleeves 61 and 62 are made of foam, for example. The spacing between the rectilinear portions 51 and 52 is selected in the third exemplary embodiment to be such that the sleeves 61 and 62 touch or are even slightly compressed against each other, once they are in place on the branches 31 and 32, as shown in FIG. 8. The sleeves 61 and 62 cover the end portions 53 and 54, at least in part.

When the device 10" is in use, the user can slide hair between the sleeves 61 and 62, for example, because of the compressibility from the materials from which the sleeves 61 and 62 are made.

Naturally, the invention is not limited to the embodiments described above.

Exemplary embodiments of the invention contemplate that the holding portion and the base and link portions could be made in other ways.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for holding a lock of hair, the device comprising:

a base portion including a surface for resting on the scalp;

a holding portion comprising an elastically deformable clip comprising two branches extending along an axis substantially parallel to the surface and that are connected together other than via the base portion, the clip being arranged to hold a portion of said lock in a substantially upstanding position between the holding portion and the scalp, the base portion extending on two opposite sides of the clip when the device is observed substantially perpendicularly to the surface of the base portion; and a link portion obliquely disposed relative to the holding portion or the base portion when viewed from a side view in a direction substantially perpendicular to the axis along which the branches extend, the link portion connecting the base portion to the holding portion so that the holding portion can be moved toward the base portion by elastically deforming the device, the link portion being configured to allow access to said portion of said lock.

2. A device according to claim 1, wherein the holding portion is situated substantially above the base portion at a non-zero distance therefrom.

3. A device according to claim 1, wherein the base portion is circularly arcuate in shape.

4. A device according to claim 1, wherein the link portion is generally U-shaped, with limbs that are connected to the base portion.

5. A device according to claim 4, wherein the link portion comprises two limbs that are connected respectively to two circumferential ends of the base portion.

6. A device according to claim 1, wherein the link portion and the base portion are made integrally.

7. A device according to claim 1, wherein the link portion and the base portion are made integrally by molding a plastics material.

8. A device according to claim 1, wherein the holding portion and the link portion are made integrally.

9. A device according to claim 1, wherein the holding portion and the link portion are made integrally by molding a plastics material.

10. A device according to claim 1, wherein the device as a whole is made as a single piece by molding a plastics material.

11. A device according to claim 1, wherein the clip has at least one branch that is hinged relative to another branch of the clip.

12. A device according to claim 1, wherein the clip comprises two branches, each hinged via a film-hinge to the link portion, the two branches being arranged in such a manner as to be capable, when in a close-together position, of co-operating so as to clamp hair therebetween.

13. A device according to claim 12, wherein the co-operation between the two branches takes place via a rim formed at a free end of one of the branches and to which the other branch may snap-fasten.

14. A device according to claim 1, wherein the clip has two branches having a spacing that is selected so as to enable hair to be clamped therebetween.

15. A device according to claim 14, wherein the two branches have two edges that are substantially touching and are of sufficient elasticity to enable a user to move said edges apart in order to insert the hair that is to be held there between.

16. A device according to claim 1, wherein the clip comprises two branches, each covered in an outer sleeve of compressible material.

17. A device according to claim 16, wherein the compressible material is a foam.

18. A device according to claim 1, wherein the clip comprises two branches having diverging end portions that facilitate insertion of hair between the branches.

19. A method of treating hair, the method comprising:

holding the root of a lock of hair in an upstanding position on the scalp by using a device as defined in claim 1; and applying a hair care substance to the hair roots when held using the device.

20. A method according to claim 19, further comprising allowing the substance to harden on drying so as to lock the hair roots in the orientation imparted thereto by the device.

21. A method according to claim 19, wherein applying a hair care substance comprises applying a polymer-rich gel.

22. A method according to claim 21, wherein the gel has a drying time greater than or equal to twenty seconds.

23. A hair treatment kit comprising:

a device for holding a lock of hair, the device comprising:

a base portion including a surface for resting on the scalp, a holding portion comprising an elastically deformable clip extending along an axis substantially parallel to the surface, the clip being arranged to hold a portion of said lock in a substantially upstanding position between the holding portion and the scalp, and a link portion connecting the base portion to the holding portion and inclined obliquely relative to the base portion when viewed from a side view in a direction substantially perpendicular to the axis along which the clip extends so that the holding portion can be moved by a user toward the base portion by elastically deforming the device and so that the holding portion can exert a tension on said lock of hair by tending to move away from the base portion once the device is no longer elastically deformed by the user, the link portion being configured to allow access to said portion of said lock; and a substance for application to the hair roots.

24. A hair treatment kit according to claim 23, wherein the substance is designed to lock the hair roots in a particular orientation on drying.

25. A device for holding a lock of hair, the device comprising:

a base portion including a surface for resting on the scalp;

a holding portion comprising a clip arranged to hold a portion of said lock in a substantially upstanding position between the holding portion and the scalp, the holding portion comprising two branches extending along an axis substantially parallel to the surface, said branches having diverging portions, when the device is observed substantially perpendicularly to the surface, that facilitate insertion of hair between the two branches; and a link portion obliquely disposed relative to the holding portion or the base portion when viewed from a side view in a direction substantially perpendicular to the axis along which the branches extend, the link portion connecting the base portion to the holding portion, the link portion being configured to allow access to the portion of said lock, wherein the link portion is made integrally with at least one of the base portion and the holding portion.

26. A device for holding a lock of hair, the device comprising:

a base portion including a surface for resting on the scalp;

a holding portion comprising an elastically deformable clip extending along an axis substantially parallel to the surface and arranged to hold a portion of said lock in a substantially upstanding position between the holding portion and the scalp, the holding portion extending at least in part above a center of a surface of the scalp delimited by the base portion; and a link portion obliquely disposed relative to the holding portion or the base portion when viewed from a side view in a direction substantially perpendicular to the axis along which the clip extends, the link portion connecting the base portion to the holding portion so that the holding portion can be moved toward the base portion by elastically deforming the device, the link portion being configured to allow access to said portion of said lock, the clip comprising an opening configured to allow the portion of the lock of hair to be inserted in the opening while being all oriented in a substantially upstanding position.

* * * * *